US011641916B2

(12) United States Patent
Faivus

(10) Patent No.: US 11,641,916 B2
(45) Date of Patent: May 9, 2023

(54) LUGGAGE CONTAINER HAVING TELESCOPING TRANSPORT HOOKS

(71) Applicant: Scott Paul Faivus, West Palm Beach, FL (US)

(72) Inventor: Scott Paul Faivus, West Palm Beach, FL (US)

( * ) Notice: Subject to any disclaimer, the term of this patent is extended or adjusted under 35 U.S.C. 154(b) by 247 days.

(21) Appl. No.: 16/851,799

(22) Filed: Apr. 17, 2020

(65) Prior Publication Data

US 2021/0321735 A1 Oct. 21, 2021

(51) Int. Cl.
*A45C 13/26* (2006.01)
*A45C 5/14* (2006.01)

(52) U.S. Cl.
CPC ..... *A45C 13/262* (2013.01); *A45C 5/14* (2013.01); *A45C 2013/265* (2013.01)

(58) Field of Classification Search
CPC .... A45C 13/262; A45C 5/14; A45C 2013/265
USPC ..... 224/181, 270, 201
See application file for complete search history.

(56) References Cited

U.S. PATENT DOCUMENTS 493,348 A * 3/1893 Barry ..... A45F 5/02 280/42
1,969,199 A * 8/1934 Battles ..... A45F 3/14 224/265
2,712,404 A * 7/1955 Miller ..... A45F 3/08 224/270
2,996,830 A * 8/1961 Reichmuth ..... F16M 13/00 248/444
3,009,613 A * 11/1961 Noland ..... A47B 31/06 224/265
3,881,644 A * 5/1975 Demaline ..... A45F 3/10 224/161
4,045,040 A * 8/1977 Fails ..... B62B 5/068 182/20
5,323,943 A * 6/1994 Elledge ..... A45F 3/14 224/265
5,464,080 A * 11/1995 Liang ..... A45C 13/262 280/37
D382,987 S * 9/1997 Johnson, Jr. ..... A45C 13/262 D2/861
5,884,362 A * 3/1999 Tsai ..... A45C 13/262 280/655
5,901,822 A * 5/1999 Tu ..... A45C 5/14 16/113.1
6,122,800 A * 9/2000 Cheng ..... A45C 13/262 280/655
6,575,274 B1 * 6/2003 Huang ..... A45C 13/262 16/113.1

(Continued)

*Primary Examiner* — Jennifer Robertson
*Assistant Examiner* — Justin Caudill
(74) *Attorney, Agent, or Firm* — The Concept Law Group, PA; Scott D. Smiley; Scott M. Garrett

(57) ABSTRACT

A luggage case includes a pair of shoulder hooks mounted on a telescoping assembly that extends from the luggage case to allow the user to place the shoulder hooks over the user's shoulders and tow the luggage case without having need for the user to use their hand(s) to tow the luggage case. The shoulder hooks are configured to swivel so that, when the telescoping assembly is collapsed, the shoulder hooks are received in respective pockets formed the top of the luggage case, and when the telescoping assembly is extended to a desired length, the shoulder hooks can be rotated to hook over the user's shoulders.

13 Claims, 17 Drawing Sheets

(56) References Cited

U.S. PATENT DOCUMENTS

| | | | | |
|---|---|---|---|---|
| 7,621,066 | B1 * | 11/2009 | Mathison | A45F 3/10 224/922 |
| 10,383,427 | B1 * | 8/2019 | Walker | A45F 3/08 |
| 10,682,025 | B2 * | 6/2020 | Rudolph | A61F 5/4556 |
| 2002/0144874 | A1 * | 10/2002 | Nykoluk | A45C 13/262 16/113.1 |
| 2004/0181906 | A1 * | 9/2004 | Kuo | A45C 13/262 16/114.1 |
| 2006/0076203 | A1 * | 4/2006 | Miller | A45C 13/262 16/113.1 |
| 2009/0272779 | A1 * | 11/2009 | Vu | A47B 23/002 224/265 |

* cited by examiner

LUGGAGE CONTAINER HAVING TELESCOPING TRANSPORT HOOKS

FIELD OF THE INVENTION

The present invention relates generally to luggage containers such as suitcases, and more particularly to luggage containers that include extendible or telescoping handle assemblies, and further to telescoping handle assemblies that include hook portions to hook over a portion of a person's body so that they can pull the luggage container in a hands-free manner.

BACKGROUND OF THE INVENTION

Luggage is commonly provided with telescoping handles that extend from, and collapse at the top or upper portion of the luggage. Typically the telescoping segments are slightly shorter than the luggage case is tall, and are housed within a portion of the back side of the luggage case. As the luggage case is typically also provided with two or more wheel elements, this allows a user to pull or otherwise control the luggage case while the luggage case rolls on the floor or other surface over which the user is traveling by extending the handle and pulling on the extended handle. Typically the user will adjust the handle so that it reaches the user's hand when their hand is held around waist level, allowing the luggage container to be pulled beside or behind the user.

While the conventional telescoping handle is a desirable improvement over the even older standard configuration of luggage containers which did not have wheels or an extending handle, it still requires the use of one hand, which prevents use of that hand for other activities while pulling the luggage container. This can present a problem for someone who desires to have use of both hands free in the process of pulling a luggage container, such as a person who is also pushing a baby stroller, or anyone else who would prefer to have their hands free while moving their luggage.

Several devices have been created to assist people move luggage with them in a way that allow their hands to be free for other things. For example, there are harnesses that facilitate attaching a strap to the handle of a luggage container, and to a point on the person's back. Others have created slings or straps designed to be placed over a user's shoulder to attach a free end to the handle of the luggage container. While these allow effective pulling of a luggage container, when a person stops and the strap goes slack, there is no control over the luggage container, and the luggage container can continue moving, bumping into the user, or something or someone else.

Therefore, a need exists to overcome the problems with the prior art as discussed above.

SUMMARY OF THE INVENTION

In accordance with some embodiments of the inventive disclosure, there is provided a luggage case that includes a case body having a front side, a back side, a top, and a bottom. The luggage case further includes at least one pair of wheel components disposed at the bottom of the case body and a telescoping handle assembly disposed on the back side. The telescoping handle assembly includes a first telescoping section and a second telescoping section that are configured parallel to each other. Each of the first and second telescoping sections are configured to extend and collapse vertically from the back side of the case body adjacent the top of the case body. Each of the first and second telescoping sections including a distal end, a first hook portion coupled to the distal end of the first telescoping section and a second hook coupled to the distal end of the second telescoping section. The first and second hooks are configured to fit over a first and second shoulder, respectively, of a user of the luggage case. The luggage case further includes a cavity into which the telescoping handle assembly collapses.

In accordance with a further feature, the first and second telescoping sections extend at least four feet from their respective collapsed positions.

In accordance with a further feature, the first and second hook portions each comprise a transverse portion and a downward portion, and wherein the downward portion is coupled to the transverse portion at an adjustable hinge that allows an angle of the downward portion with respect to the transverse portion to be adjusted.

In accordance with a further feature, the first and second hook portions are each comprised of a single arcuate member.

In accordance with a further feature, the luggage case includes first and second pockets formed in a wall of the luggage case to receive the first and second hooks when the first and second telescoping sections are collapsed.

In accordance with a further feature, the first and second telescoping sections each comprise a swivel at their respective distal ends that allow the first and second hooks to swivel about a first axis of the first telescoping section and an axis of the second telescoping section, respectively.

In accordance with some embodiments of the inventive disclosure, there is provided a luggage case that includes a case body having a front side, a back side, a top, and a bottom. The luggage case further includes at least one pair of wheel components disposed at the bottom of the case body and a telescoping handle assembly disposed on the back side. The telescoping handle assembly includes a telescoping extension disposed in a channel in the back side of the case body that is telescopically extendible therefrom. The telescoping extension has a distal end. There is further included a horizontal cross member coupled to the distal end of the telescoping extension at a center of the horizontal cross member. The horizontal cross member further includes a first end and a second end opposite the first end. There is further included a first shoulder hook coupled to the horizontal cross member at the first end of the horizontal cross member, and a second shoulder hook coupled to the horizontal cross member at the second end of the horizontal cross member.

In accordance with a further feature, the horizontal cross member is connected to the distal end of the telescoping extension via a swivel connection that allows the horizontal cross member to rotate around an axis of the telescoping extension.

In accordance with a further feature, the luggage case further comprises a first pocket in which to receive the first shoulder hook and a second pocket in which to receive the second shoulder hook.

In accordance with a further feature, the telescoping extension comprises a pivot point between an upper portion of the telescoping extension and a lower portion of the telescoping extension, wherein the upper portion of the telescoping extension includes the distal end of the telescoping extension.

In accordance with a further feature, there is further included a strap loop disposed on an upper portion of the telescoping extension.

In accordance with a further feature, there is further included a strap that passes through the strap loop and is configured to go around a user's torso.

In accordance with a further feature, there is further included a swivel a lower end of the upper portion of the telescoping extension connected at the pivot point that swivels about an axis of the upper portion of the telescoping extension.

In accordance with a further feature, there is further included a brace member coupled at a first end to the upper portion of the telescoping extension and at a second end to the lower portion of the telescoping extension, wherein the brace member is configured to fix the upper and lower portions of the telescoping extension is a selection angle relative to each other.

In accordance with some embodiments of the inventive disclosure, there is provided a luggage case that includes a case body having a front side, a back side, a top, and a bottom, and at least one pair of wheel components disposed at the bottom of the case body. the luggage case further includes a telescoping handle assembly disposed on the back side that has a shoulder hook assembly that collapse into a portion of a wall of the luggage case and extends therefrom to any one of different selectable lengths. The telescoping handle assembly includes a pair of shoulder hooks that can swivel from a storage position to a towing position.

In accordance with a further feature, each shoulder hook of the pair of shoulder hooks is mounted on a distal end of a respective telescoping extension.

In accordance with a further feature, each of the pair of shoulder hooks are mounted on an opposing end of a horizontal cross member that is connected at a center of the horizontal cross member to a distal end of a telescoping extension positioned at a center of the back side of the luggage case and wherein the telescoping extension collapses into a channel formed in a wall of the luggage case at the back side of the luggage case.

In accordance with a further feature, the telescoping extension comprises an upper portion and a lower portion, wherein the upper and lower portions are coupled at a pivot point.

In accordance with a further feature, there is further included a strap loop disposed on an upper portion of the telescoping extension.

In accordance with a further feature, there is further included a strap that passes through the strap loop and is configured to go around a user's torso.

Although the invention is illustrated and described herein as embodied in a luggage case having extendible shoulder hooks for towing the luggage case, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the extendible shoulder hook assembly. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
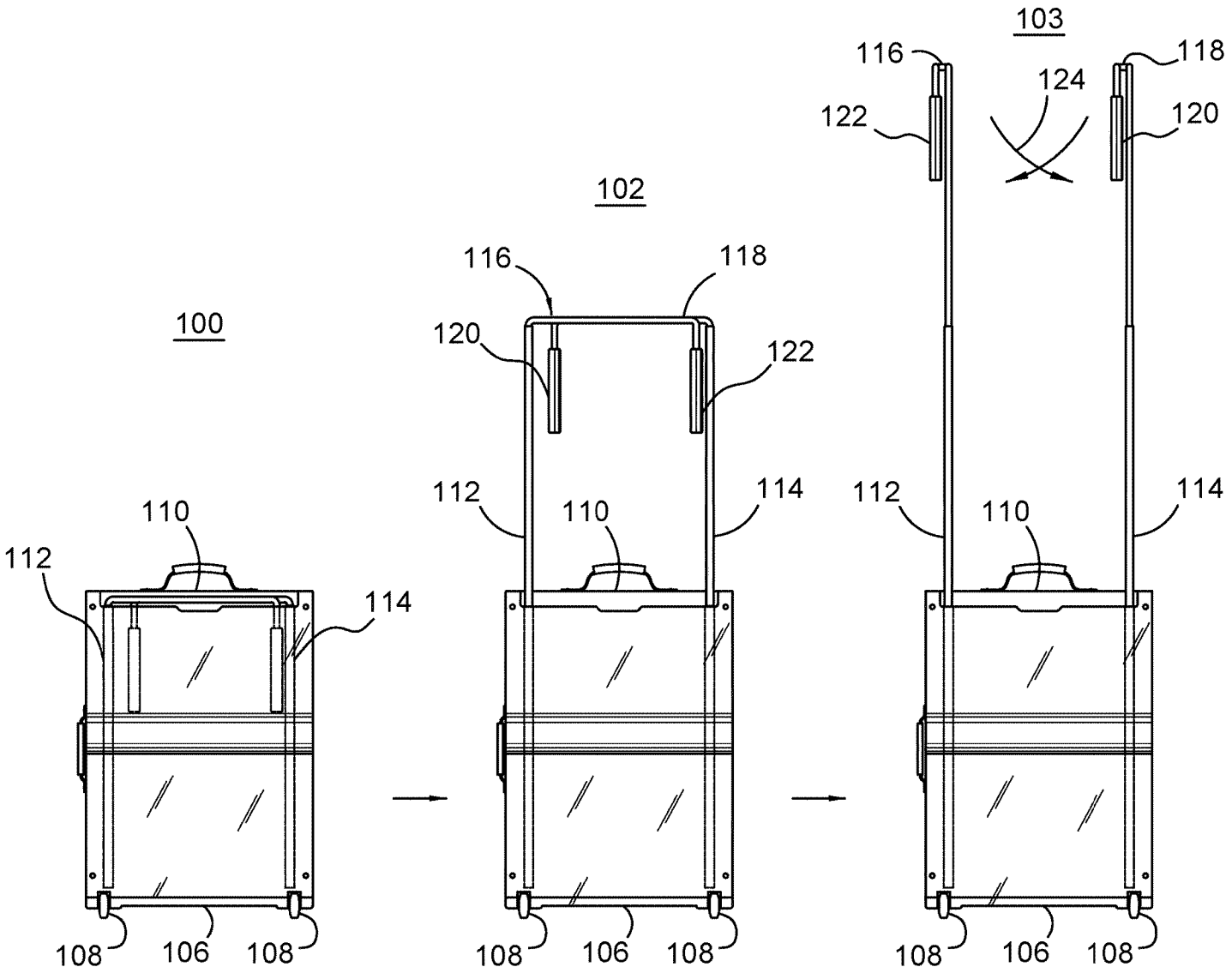
FIG. 1 is a front view sequence diagram of a luggage case deploying a telescoping handle hook assembly for handless towing of the luggage case, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient luggage case having a telescoping handle for handless towing. Embodiments of the invention provide a telescoping handle that extends sufficiently to engage the upper body of a user so that the user can tow or pull the luggage case without using a hand. In addition, embodiments of the invention provides that the telescoping handle can be concealed within a portion of the luggage case.

Figure 2:
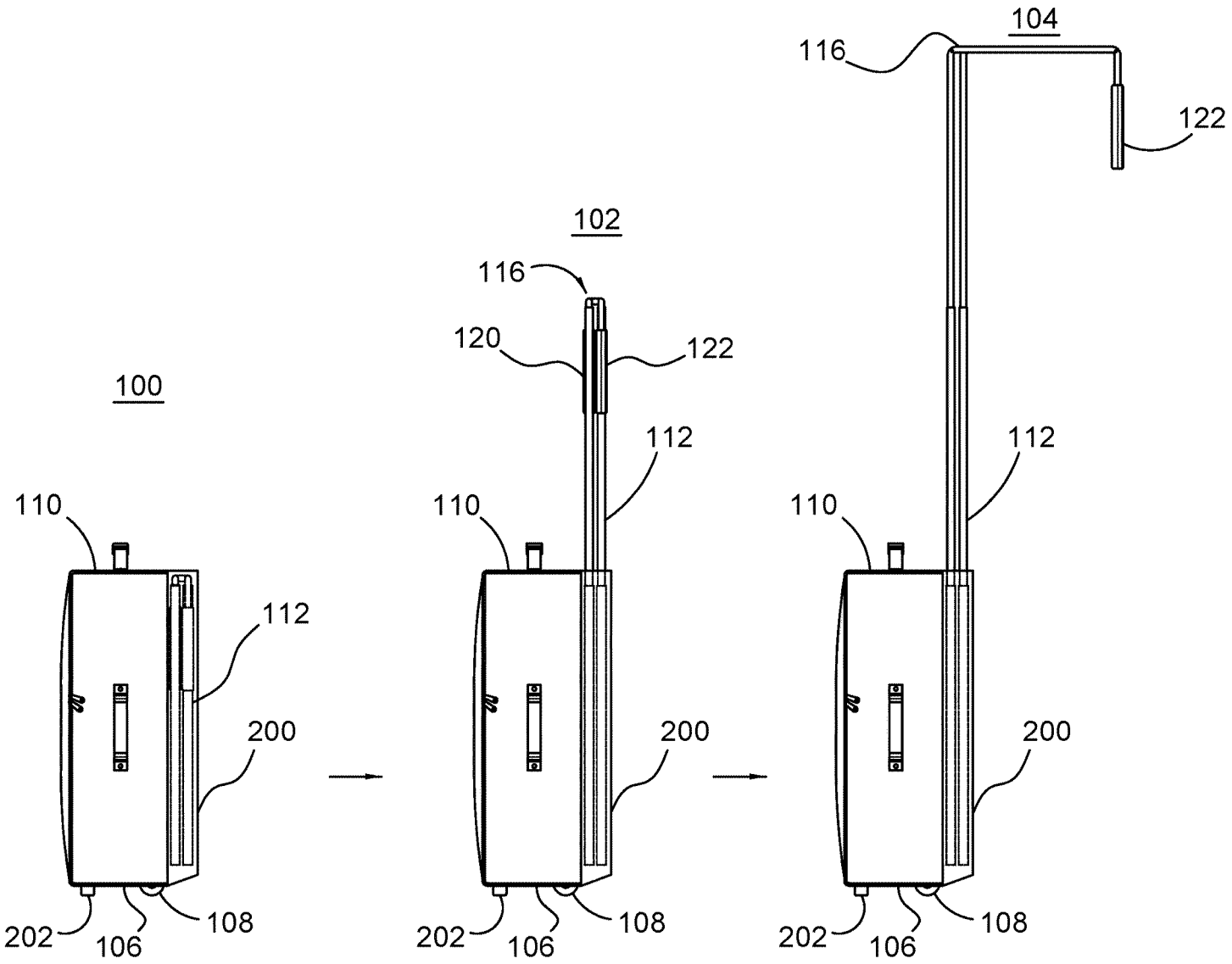
FIG. 2 is a side view sequence diagram of a luggage case deploying a telescoping handle hook assembly for handless towing of the luggage case, in accordance with some embodiments.

FIG. 1 is a front view sequence diagram of a luggage case 106 deploying a telescoping handle hook assembly for handless towing of the luggage case 106, in accordance with some embodiments. In a first part 100 of the sequence, the handle is fully concealed within the luggage case 106, and in particular in a cavity formed in a front side of the luggage case 106 that will be facing the user when the user tows the luggage case 106 using the handle. In the second part 102 the handle is partially extended, and in the third part 104 the handle is fully extended. FIG. 2 shows the same sequence for a side view.

Referring collectively now to FIGS. 1 & 2, the luggage case 106 has a case body having a front side, a back side, a top, and a bottom, and includes wheels 108 at a bottom side of the luggage case 106 adjacent the front side. In some embodiments skid posts 202 can be positioned on the other side of the bottom of the luggage case 106, opposite the wheels, to prevent the luggage case 106 from rolling away. The handle assembly is accessible from the top 110 of the luggage case 106, and includes a first telescoping section 112 and a second telescoping section 114. The telescoping sections can collapse into a portion 200 on the front side of the luggage case 106 that is provided to house the telescoping sections 112, 114. The telescoping sections 112, 114 can be made of coaxial metal tubing or cylindrical sections as is common for telescoping luggage handles. Each of the telescoping sections 112, 114 include a hook portion at the top of the telescoping sections 112, 114 that can include a cross member 116, 118, respectively, and a downward portion 122, 120, respectively.

As can be seen, in the collapsed position in the first part 100 of the sequence diagrams, the cross members 116, 118 oriented toward the opposite telescoping section 112, 114, with the catch portions 120, 122 adjacent the main shaft of the opposite telescoping portion 112, 114. Once the telescoping sections 112, 114 are raised sufficient for the catch portions to clear the top 110 of the luggage case, that can be pivoted as indicated by arrows 124 to be substantially parallel and extending forward of the luggage case 106, such that the catch portions 120, 122 hang in front of the front of the luggage case 106 by about the distance of the cross members 116, 118. In particular, in FIG. 2 the third part 104 of the sequence shows of the top of the telescoping portion 112, with cross member 116 and catch portion 122 form an inverted hook that can engage a user at the user's shoulders so the user can tow the luggage case without using either of the user's hands. Accordingly the telescoping sections 112, 114 can extend four or more feet from the top 110 of the luggage case, which is itself on the order of two or more feet tall, so as to fit most people. The telescoping sections 112, 114 can be adjustable with spring stops to select an appropriate height of the telescoping sections 112, 114, as desired by the particular user. The cross members 116, 118 can be pivoted about the axis of telescoping sections 112, 114, and there can be an interference built into the tubing so that the cross members can only be pivoted about ninety degrees, or some other selected angle, to prevent the cross members 116, 118 from pivoting off the user's shoulders. In FIG. 2, in the second part 102 of the sequence, it can be seen that the cross members 116, 118 can be offset from each other at their respective telescoping section to allow them collapse into the luggage case together. This is shown in FIG. 3.

Figure 3:
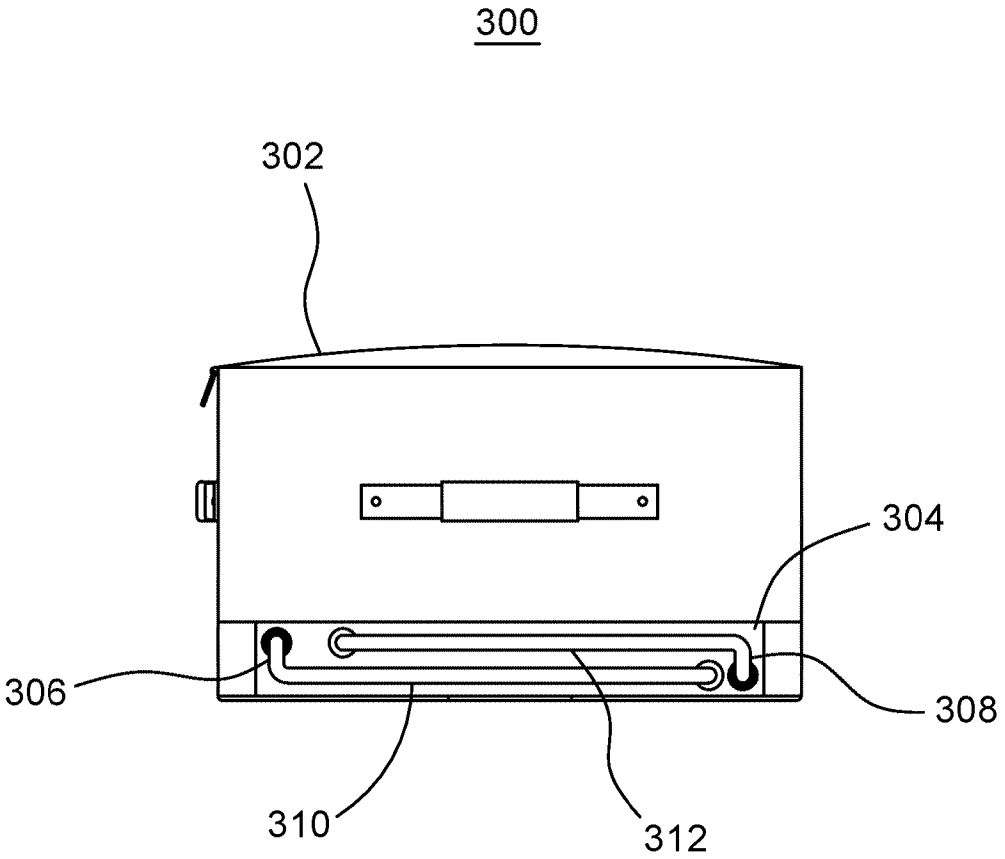
FIG. 3 is a top view of a luggage case having a telescoping handle hook assembly for handless towing retracted inside a hook concealer of the luggage case, in accordance with some embodiments.

FIG. 3 is a top view of a luggage case 300 having a telescoping handle hook assembly for handless towing retracted inside a hook concealer of the luggage case, in accordance with some embodiments. The top 302 of the luggage case 300 is seen, and includes a cavity 304 formed into the luggage case 300 from the top 302. The cavity houses the telescoping sections 306, 308, and in this view the axis of the telescoping section 306, 308 is in and out of the page. Cross member 310 is attached to telescoping section 306, and has a horizontal axis that is offset from the vertical axis of the telescoping section 306. Similarly, cross member 312 is attached to telescoping section 308 and is likewise offset from telescoping section 308, in the opposite direction from that of cross member 310 relative to telescoping section 306, allowing cross members 310, 312 to somewhat interleave with each other in the cavity 304, when the telescoping sections 306, 308 are collapsed into the cavity 304 and not in use. Upon deployment, the telescoping sections 306, 308 can be extended upwards (e.g. out of the page), and cross members 310, 312 can be pivoted forward as indicated in FIGS. 1-2. By offsetting the cross members 310, 312 they can lay parallel to each other in the cavity 304, and parallel to a line between the telescoping sections 306, 308.

Figure 4:
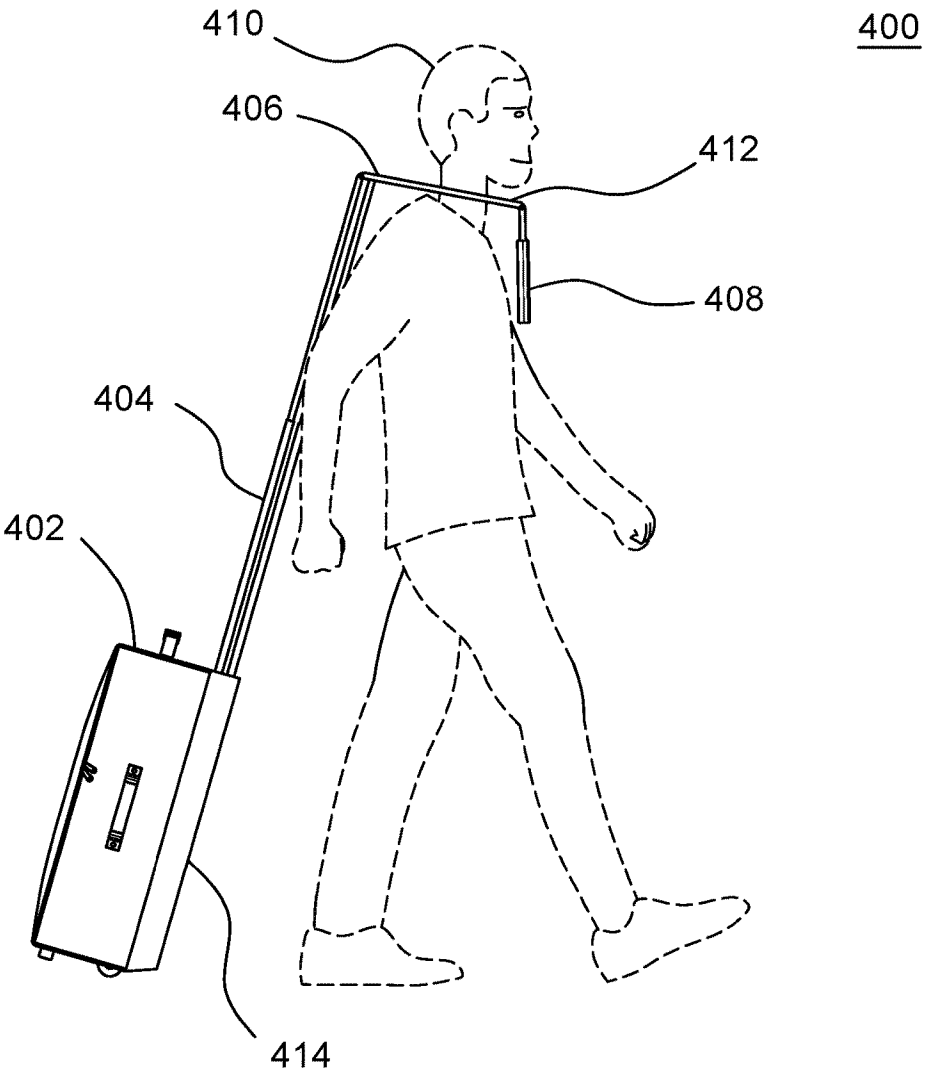
FIG. 4 is a side view of a luggage case having a telescoping handle hook deployed and extended to engage a user's shoulders to allow handless towing of the luggage case, in accordance with some embodiments.

FIG. 4 is a side view 400 of a luggage case 402 having a telescoping handle hook deployed and extended to engage a user's shoulders to allow handless towing of the luggage case, in accordance with some embodiments. The luggage case 402 includes a portion 414 in which a cavity of formed to receive the telescoping handle assembly. That is the telescoping handle assembly can be collapsed and concealed in the cavity of the portion 414. The telescoping handle assembly include telescoping portions such as telescoping section 404 that extends from the cavity in portion 414 in a telescoping manner. There can be three to four coaxial sections in the telescoping sections 404 so that the telescoping sections 404 can both fully collapse into the luggage case body, and extend far enough to engage a person's shoulders 412 assuming a person of approximate average height. The telescoping sections 404 are anchored in the luggage case such that they can only extend upward, or collapse downward. Thus, if the luggage case is leaned over, the telescoping sections 404 will lean with the luggage case 402, and likewise, leaning or pulling on the extended telescoping sections 404 can cause the luggage case 402 to lean correspondingly.

Accordingly, a user 410 can extend the telescoping sections 404 such that a cross member 406 at the top end of each telescoping section is at a height such that the luggage case 402 will lean over when the cross member 406 is over the shoulder 412 of the user 410. The catch portion 408 extends downward across a portion of the front of the user 410 to retain the telescoping assembly on the user's shoulder 412. Accordingly, the user 410 can tow the luggage case 402 without using their hands while maintaining control over the luggage case 402. The direct coupling between the user 410 and the luggage case created by the stiff telescoping sections 404 avoids problems associated with prior art luggage towing using straps or similar loose coupling structures.

Figure 5:
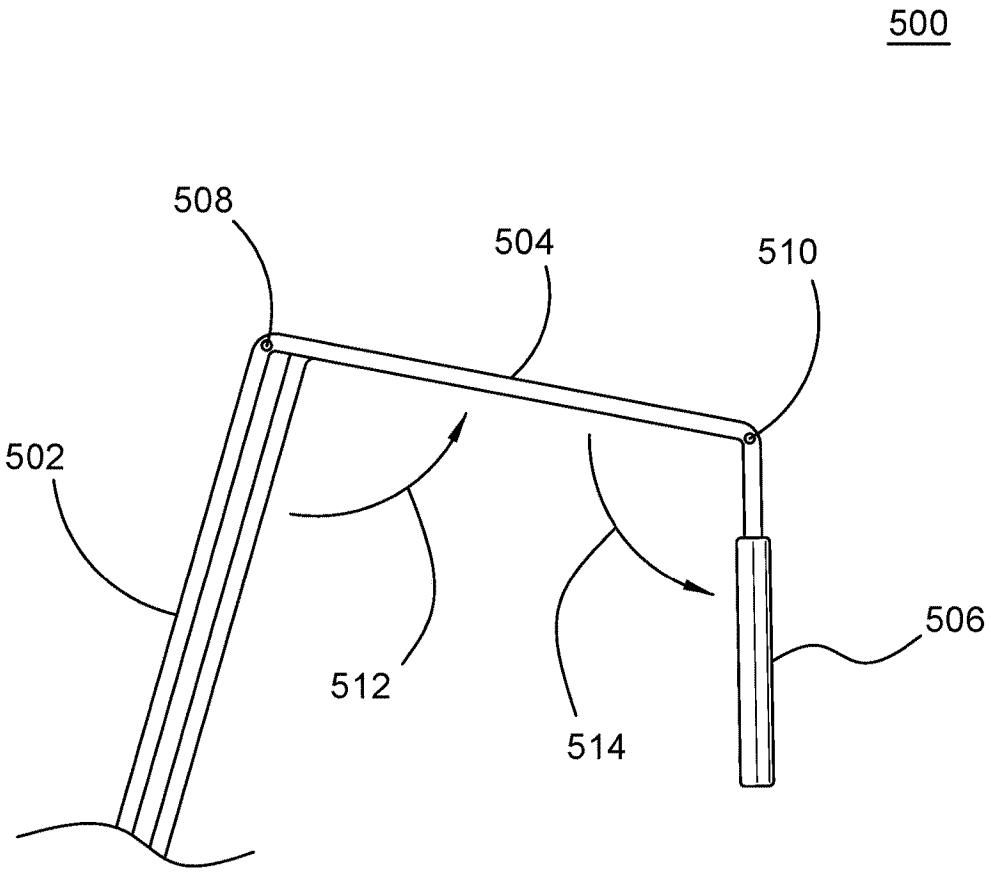
FIG. 5 is a side view of a hook portion of a telescoping hook handle, in accordance with some embodiments.

FIG. 5 is a side view of a hook portion 500 of a telescoping hook handle, in accordance with some embodiments. The telescoping section 502, which is anchored in the luggage case, connects to a cross member 504 at a hinge 508. Likewise, the cross member 504, at its opposite end, connects to a catch member 506 at a similar hinge 510. The hinges 508, 510 allow movement of the cross member 504 relative to the telescoping section 502 as indicated by arrow 512, and of the catch member 506 relative to the cross member 504 as indicated by arrow 514. The structure at each hinge can limit the degree of movement. In some embodiments the cross member 504 can normally be held at a ninety degree angle to the telescoping section 502, and the hinge 508 can allow another forty five degrees of angle. Likewise, hinge 510 can allow additional angle beyond ninety degrees between the cross member 504 and the catch member 506. The freedom of movement provided by the hinges 508, 510 allows the hook portion to conform to various body sizes, as well as preferences for angle of towing the luggage case.

Figure 6:
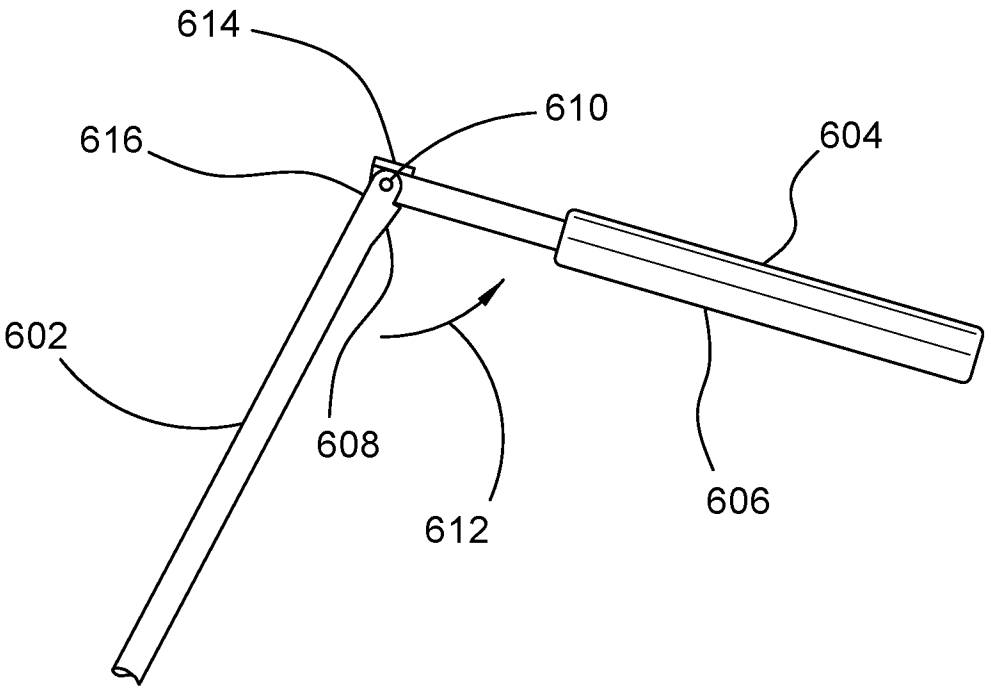
FIG. 6 is a detail of a joint forming a hook portion of a telescoping hook handle for a luggage case, in accordance with some embodiments.

FIG. 6 is a detail of a joint forming a hook portion of a telescoping hook handle for a luggage case, in accordance with some embodiments. The upper portion of a telescoping section 602 is joined to a cross member 604 at a hinge 610. The angle 612 between the telescoping section 602 and the cross member 604 is controlled by interference features. For example, to ensure a minimum angle, a stop feature 608 can bear against the bottom 606 of the cross member 604 when the cross member 604 is at the minimum angle relative to the telescoping section 602. A maximum angle can be selected by the positioning of a second stop feature 614 on the heel of the cross member 604, which bears against the top 616 of the telescoping section 602 when the maximum angle is reached. A coil spring around the pin of the hinge 610 can be used to bias the cross member 604 to the minimum angle position. A similar arrangement can be used at the hinge connecting the cross member 604 to the catch member (not shown) to control the minimum and maximum angles between the two members.

Figure 7:
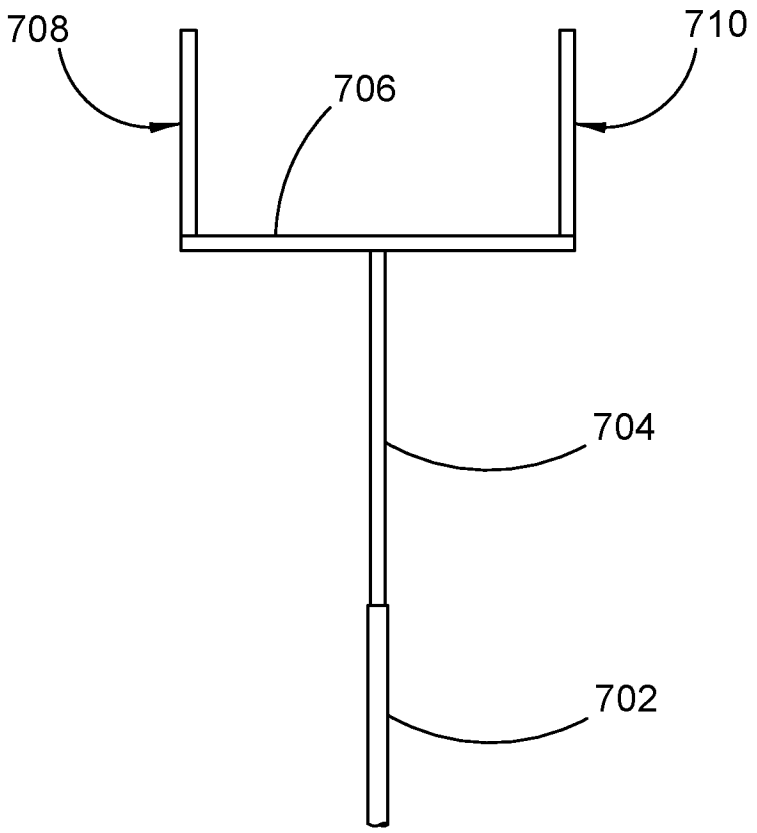
FIG. 7 is a front view of a top portion of a telescoping hook handle having a single main portion, in accordance with some embodiments.
Figure 8:
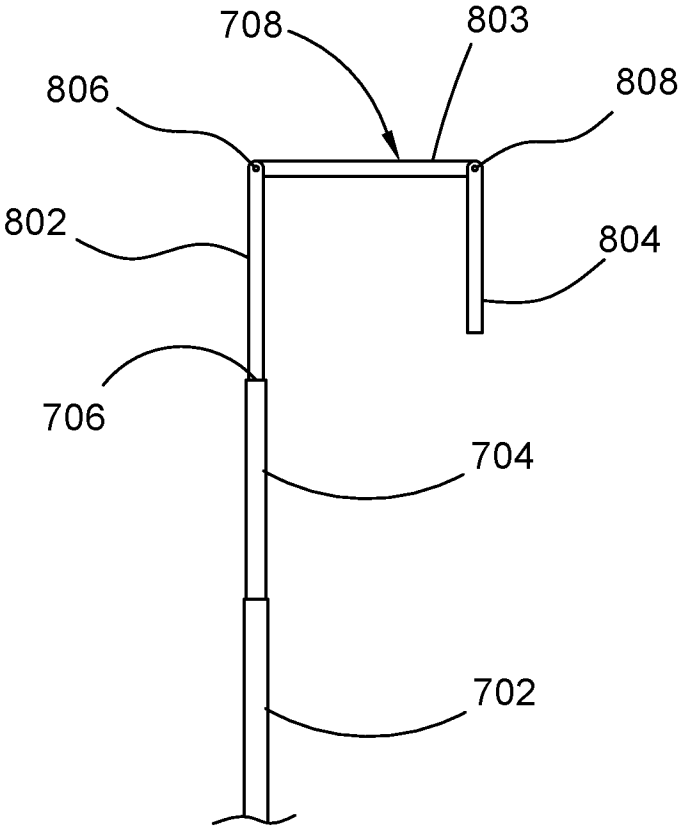
FIG. 8 is a side view of a top portion of a telescoping hook handle having a single main portion, in accordance with some embodiments.

FIG. 7 is a front view of a top portion of a telescoping hook handle having a single main portion. FIG. 8 shows the same device as in FIG. 7 from a side view. In this arrangement, rather than there being two different telescoping section, there is one main telescoping portion 702 having a terminal section 704 that forms a "T" crossbar 706 having opposing ends. At each of the opposing ends is hook structure 708, 710, Each of the hook structures include a vertical riser portion (e.g. 802) that extends vertically from the T-shaped crossbar 706. The vertical riser portion joins to a cross member (e.g. 803), which in turn joins to a catch member (e.g. 804). Hinges 806, 808 can allow movement of the cross and catch members as described in regard to FIGS. 5-6. The hook portions 708, 710 can be configured to pivot on the cross bar 706 toward each other so that the handle assembly and be collapsed into the luggage case substantially as described in regard to FIG. 3.

Figure 9:
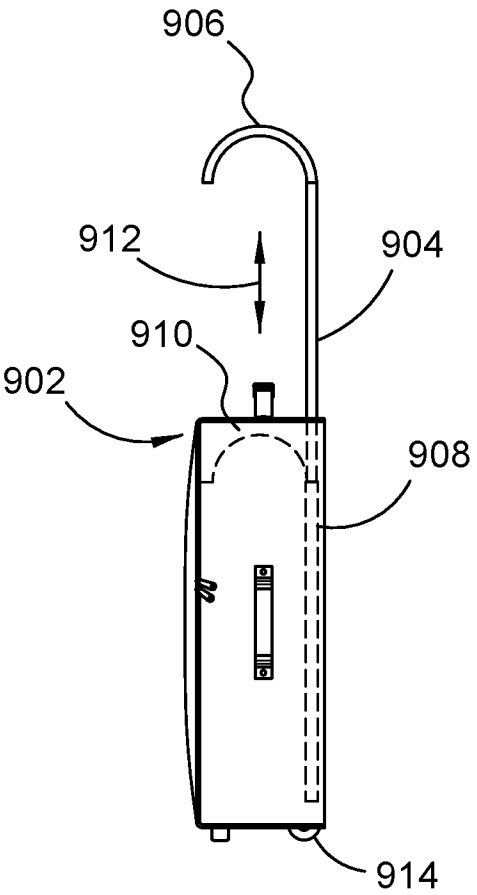
FIG. 9 is a side view of a first side of a luggage case including telescoping shoulder hook handles that are partially extended, in accordance with some embodiments.

FIG. 9 is a side view of a first side of a luggage case 902 including telescoping shoulder hook handles that are partially extended, as shown, in accordance with some embodiments. The luggage case 902 includes one or more telescoping extensions 904 that are housed inside a corresponding channel 908 when collapsed. The extensions 904 comprise telescoping tubes that can be adjusted to selected lengths as desired by a user. That is, the extensions 904 can be adjusted to different selectable lengths to suit different users of different heights. Specifically, the user can extend the extensions 904, as indicated by arrow 912, to a distance that allows the user to place shoulder hooks 906 over the user's shoulders, allowing the user to tow the luggage case 902 behind the user as the user walks. To accomplish this, the extensions 904 have to be able to achieve a length such that the luggage case 902 will lean over and tend to stay leaned over at an angle, such as by shifting the center of gravity of the luggage case forward of the wheels 914, otherwise the luggage case 902 will tend to stand back up vertically as shown here. Thus, the extensions 904 may contain as many as four telescoping sections to accommodate people of different heights.

The shoulder hooks 906 are mounted on a rotating connector at the top of the extensions 904, which allows the shoulder hooks 906 to rotate one hundred eighty degrees from the position shown here, allowing them to be placed over a user's shoulders. When not being used, the shoulder hooks 906 can be placed in the position shown, and the extensions 904 collapsed into the channel 908, with the shoulder hooks 906 being lowered into pockets 910 formed in the luggage case 902. The pockets 910, like the channel 908, can be formed in the wall of the luggage case 902, which can be a two-part wall, with an inner wall layer and an outer wall layer, where the pockets 910 and channel 908 are formed between the inner and outer wall layers.

Figure 10:
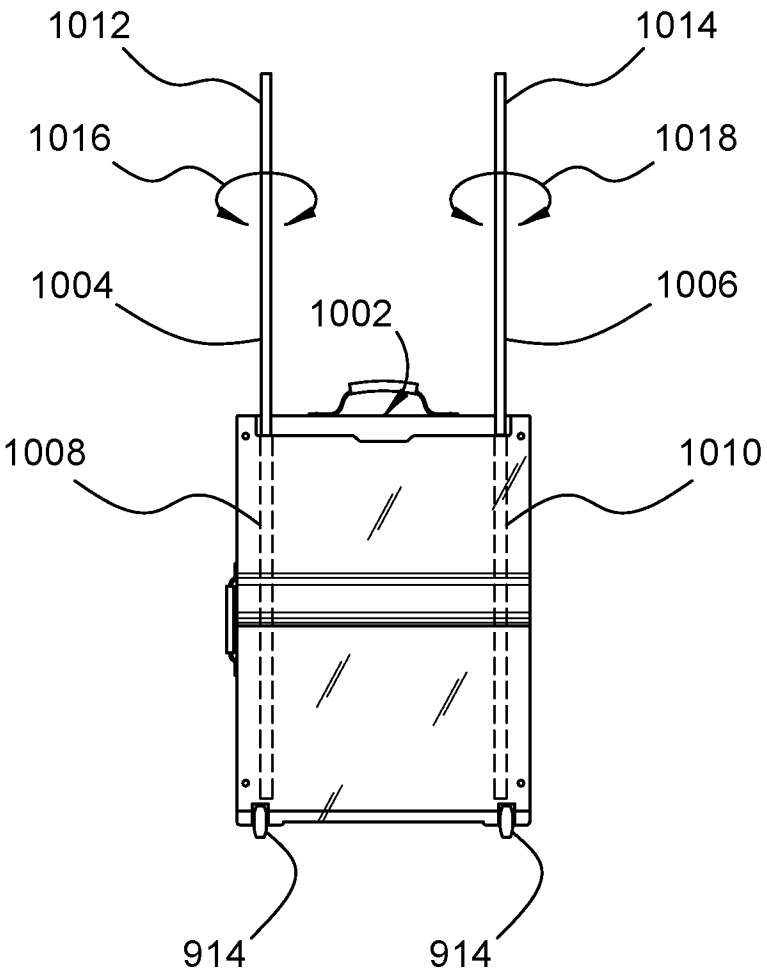
FIG. 10 is a side view of a second side of a luggage case including telescoping shoulder hook handles that are partially extended, in accordance with some embodiments.

In FIG. 10 is a side view of a second side of a luggage case 1002 including telescoping shoulder hook handles 1012, 1014 that are partially extended, in accordance with some embodiments. FIG. 10 shows an embodiment that uses two extensions 1004, 1006 which are independent of each other, and are each coupled, at their distal end, to a respective shoulder hook 1012, 1014. The shoulder hooks 1012, 1014 have the same general shape as shoulder hook 906, and can be rotated about the axis of their respective extension 1004, 1006 as indicated by arrows 1016, 1018, and have a range of rotation of at least one hundred eighty degrees. The extensions 1004, 1006 are comprised of telescoping tubular members that can be adjusted in length to a desired length, and can collapse into a base tube member that is located in a channel 1008, 1010 in the wall of the luggage case.

Figure 11:
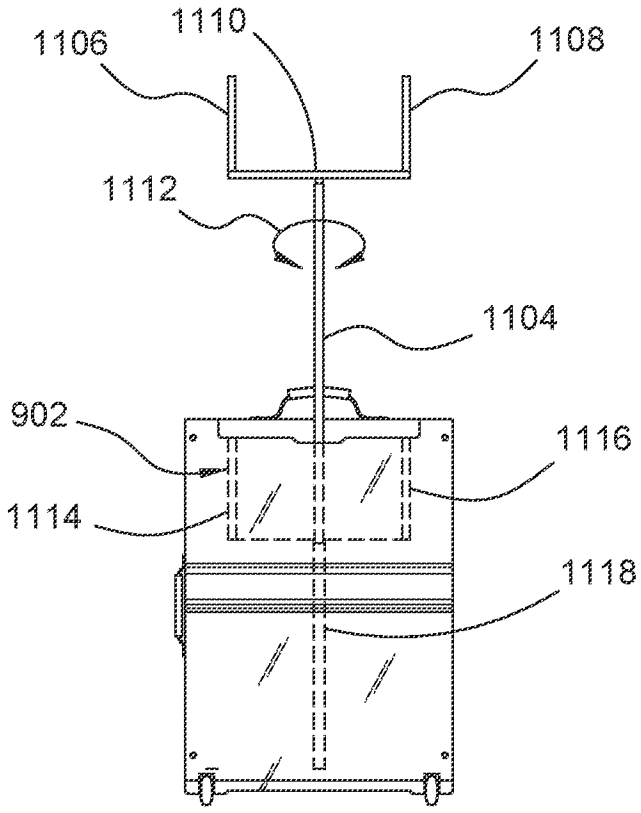
FIG. 11 is a side view of a luggage case having a partially extended telescoping extension that couples to a member having shoulder hooks, in accordance with some embodiments.
Figure 12:
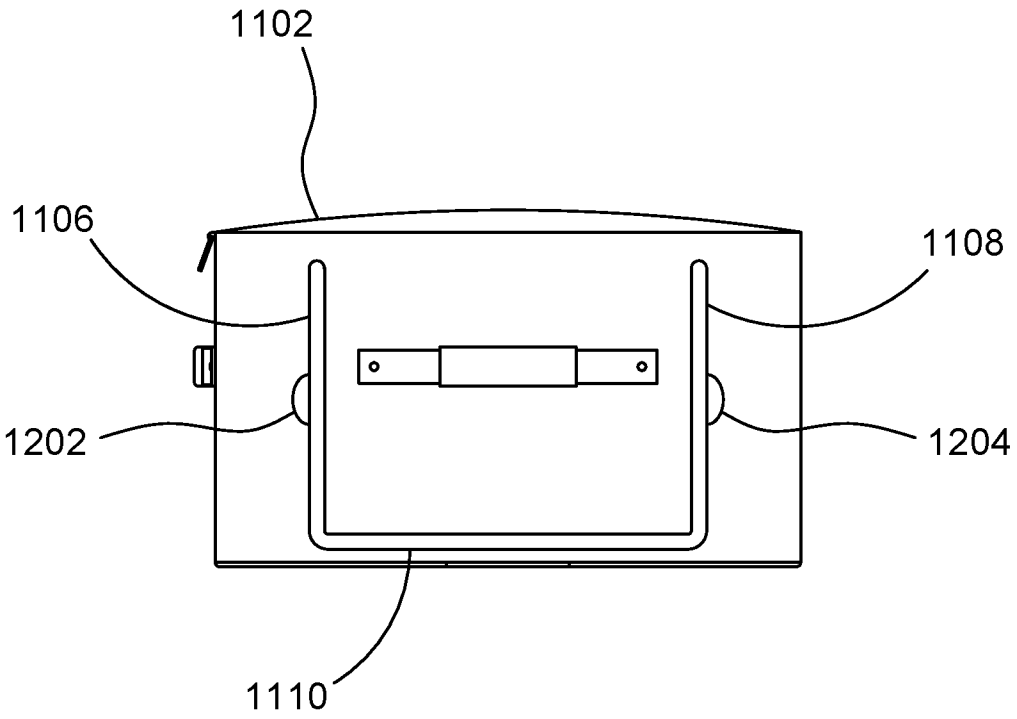
FIG. 12 is a top view of a luggage case having a telescoping shoulder hook portion, in accordance with some embodiments.

FIG. 11 is a side view of a luggage case 1102 having a partially extended telescoping extension 1104 that couples to a member having shoulder hooks 1106, 1108, in accordance with some embodiments. Shoulder hooks 1106, 1108 have the same general shape as shoulder hook 906, but are attached to a horizontal cross member 1110 that is in turn mounted on the extension 1104. The cross member 1110 rotates, as indicated by arrow 1112, on the axis of the extension 1104. The extension 1104 is a telescoping assembly of co-axial tube members, as is well known, and can be adjusted to a desired length such as by a sprung protrusion in one of the telescoping members that can extend through one of several holes in another, outer telescoping member. The extension 1104 can collapse into a channel 1118 formed in the wall of the luggage case 1102, and similarly, the cross member 1110 and shoulder hooks 1106, 1108 can sit in pockets 1114, 1116 and a connecting trough/pocket between pockets 1114, 1116, as shown in FIG. 12. FIG. 12 shows a top view of luggage case 1102 with the extension 1104 collapsed so that shoulder hooks 1106, 1108 are sitting in pockets 1114, 1116. To allow a user to easily pull/lift the shoulder hooks 1106, 1108 out of the luggage case 1102, there can be a corresponding access depression 1202, 1204 for each shoulder hook 1106, 1108 formed in the luggage case. The depressions 1202, 1204 allow a user to insert a finger under the shoulder hooks 1106, 1108. Using a single extension 1104, instead of two (as in FIG. 10), allows a user to turn their shoulders with the shoulder hooks over their shoulders.

Figure 13:
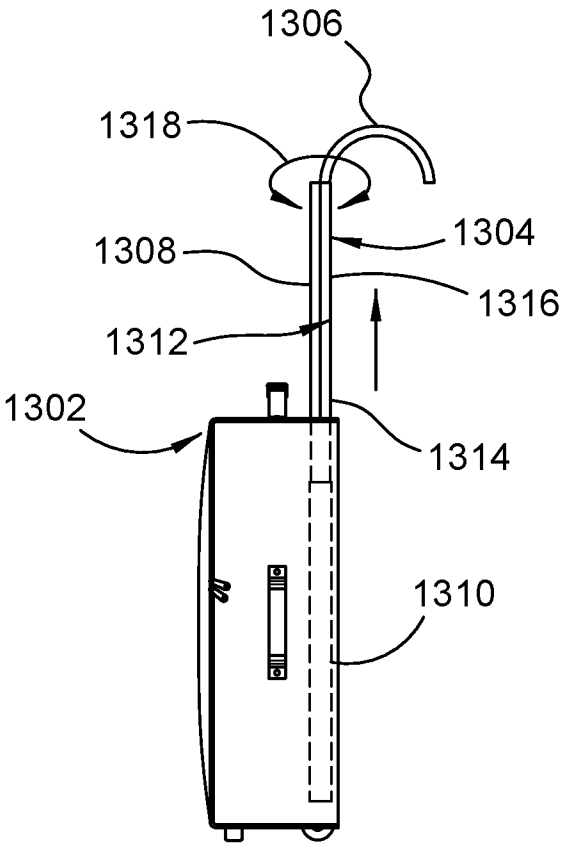
FIG. 13 is a side view of a luggage case having a telescoping shoulder hook portion with a brace member, in accordance with some embodiments.

FIG. 13 is a side view of a luggage case 1302 having a telescoping shoulder hook portion with a brace member, in accordance with some embodiments. This allows a lower effective connection point to the user, and an increased angle at which the luggage case is leaned when being towed by the shoulder hooks. An extension 1304 includes a pivot point 1312 that divides the extension 1304 into a lower portion 1314 and an upper portion 1316. The pivot point can be an adjustable hinge that can be locked in position. The upper portion 1316 can pivot backward from the position shown at the pivot point 1312. The lower portion 1314 is telescoping, and includes several coaxial/concentric tube members that collapse or extend as needed by the user. The arrangement of the telescoping shoulder hook portion shown here can be substantially similar to that shown in FIG. 16. The extension 1304 can collapse into a channel 1310 in the luggage case 1302.

Figure 14:
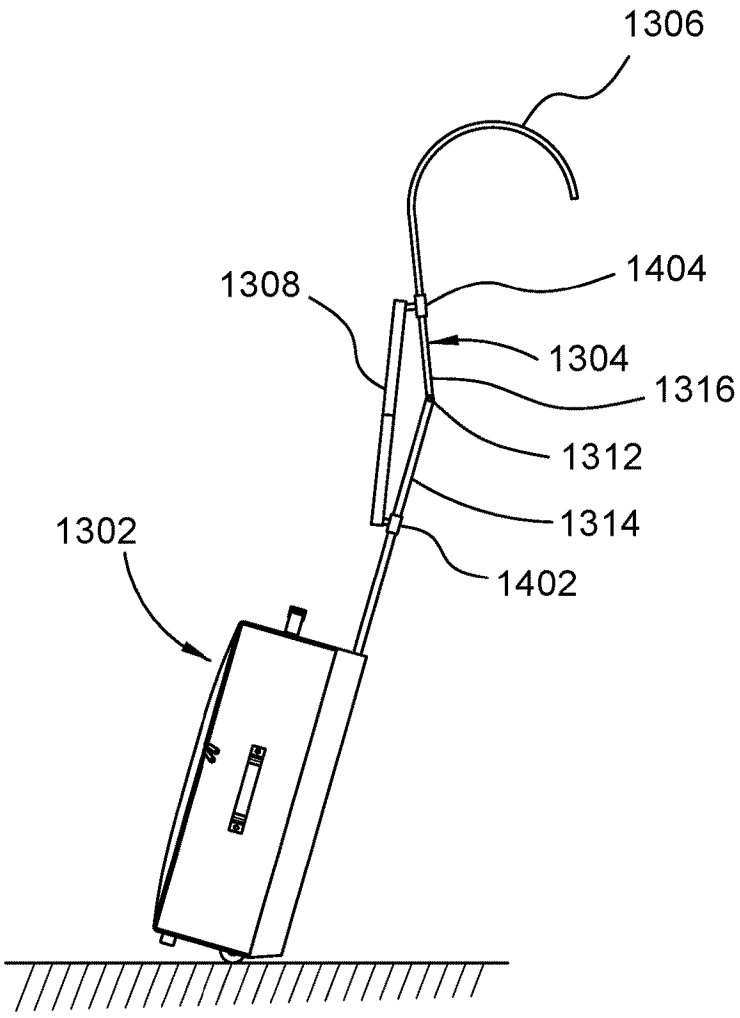
FIG. 14. is a side view of a luggage case having a deployed telescoping shoulder hook portion with a brace member, in accordance with some embodiments.

At the top of the extension 1304 is a cross member to which a pair of shoulder hooks 1306 are connected. The cross member can rotate about an axis of the extension 1304, as indicated by arrow 1318. A brace member 1308 couples, at a first end, to the lower portion 1314 of the extension 1304, and at a second end to the upper portion 1316 of the extension 1304. The brace member 1308 holds the lower and upper portions 1314, 1316 in a fixed position once the upper portion 1316 is tilted at the pivot point 1312, as shown in FIG. 14. In FIG. 14, the luggage case 1302 is shown leaned over at an angle, as it would be when being towed by a person with the shoulder hooks 1306 over the person's shoulders. The brace member 1308 can include a sliding and locking clasp 1402 at the lower end of the brace member 1308 that can encircle the lower portion 1314 of the extension 1304, and can be adjusted to frictionally engage the lower portion 1314 of the extension 1304. A similar clasp 1404 can be provided at the top of the brace member 1308 to engage the upper portion 1316 of extension 1304. This allows the upper portion 1316 to be tilted at an angle, relative to the lower portion 1314, and held in that position. When so fixed, with the shoulder hooks 1306 over the user's shoulders, the connection point to the user is essentially at the pivot point 1312. This ensures that a taller person can still use the shoulder hook assembly to tow the luggage case 1302 as the angle of lean of the luggage case 1302 ensures that the luggage case 1302 will not tend to "stand up," and will remain leaned over while being towed.

Figure 15:
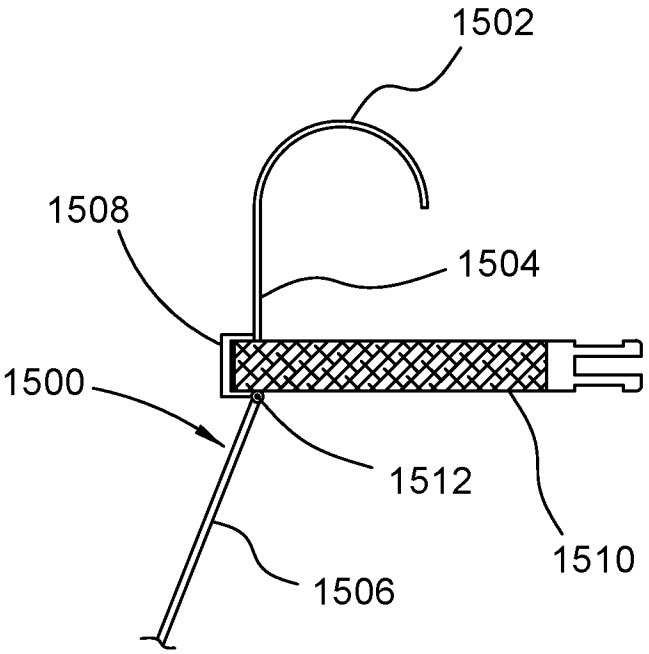
FIG. 15 is a side view of a shoulder hook portion for a telescoping extension of a luggage case, using a strap to secure the shoulder hook in place, in accordance with some embodiments.

FIG. 15 is a side view of a shoulder hook portion for a telescoping extension of a luggage case, using a strap to secure the shoulder hook in place, in accordance with some embodiments. A strap 1510 can be used in place of a bracing member (e.g. 1308) to hold the shoulder hook 1502 in place over a user's shoulders. A telescoping extension 1500 includes a lower portion 1506 and an upper portion 1504 which are coupled together at a pivot point 1512. The upper portion 1504 supports the shoulder hooks 1502 (only one is seen here in the side view). At or near the base of the upper portion 1504 is a strap loop 1508 for retaining a strap 1510 that passes through the strap loop 1508. The strap 1510 can pass around the user at about torso at chest level to hold the upper portion 1504 at substantially a vertical orientation, allowing an increased angle of lean of the luggage case (not shown here).

Figure 16:
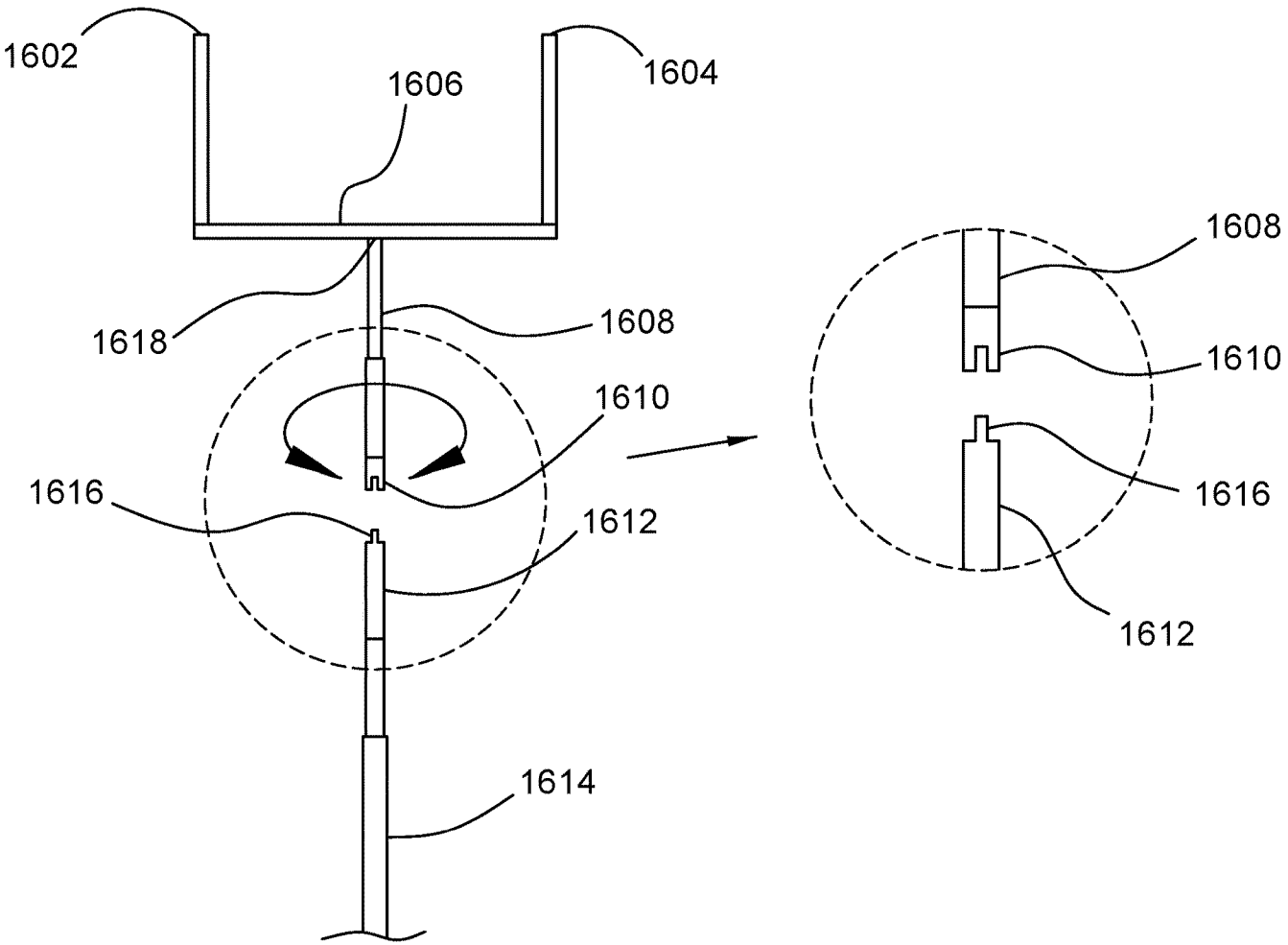
FIG. 16 shows a shoulder hook extension for a luggage case including a rotating and pivoting connection, in accordance with some embodiments.

FIG. 16 shows a shoulder hook extension for a luggage case including a rotating and pivoting connection, in accordance with some embodiments. The assembly includes two shoulder hooks 1602, 1604 which are shaped to go over a user's shoulders. The shoulder hooks 1602, 1604 are each connected to a cross member 1606 at opposite ends of the cross member 1606. The cross member 1606 is coupled, at its middle, to the upper portion 1608 of an extension that telescopes to collapse into a luggage case. At the bottom of the upper portion 1608 is a rotating swivel member 1610 which rotate about the axis of the upper portion 1608 and is connected thereto. The swivel member 1610 can include a connection tongue that connects to a corresponding tongue 1616 in a way that allows the lower portion 1612 to pivot. The connection can be made by a transverse pin or equivalent that passes through both portions in a way that allows them to move relative to each other. Thus, the action of the pivot interface and the rotation of the swivel member 1610 allows a universal joint effect that allows for easier towing of a luggage case by a person as it accommodates the motions of a person as they walk and turn. The lower portion 1612 can telescope with one or more telescoping members 1614 to collapse into the luggage case for storage when the user is not using the shoulder hooks to tow the luggage case. As shown there, the swivel member 1610 is located below the cross member 1606. The distance from the cross member 1606 can be on the order of zero to twelve inches in some embodiments. That is, the swivel could be located at or on the cross member 1606 at point 1618. A ball joint or other equivalent structure could be used in place of the swivel, as well. The telescoping members 1614 can then be connected directly to the center of the cross member 1606.

Figure 17:
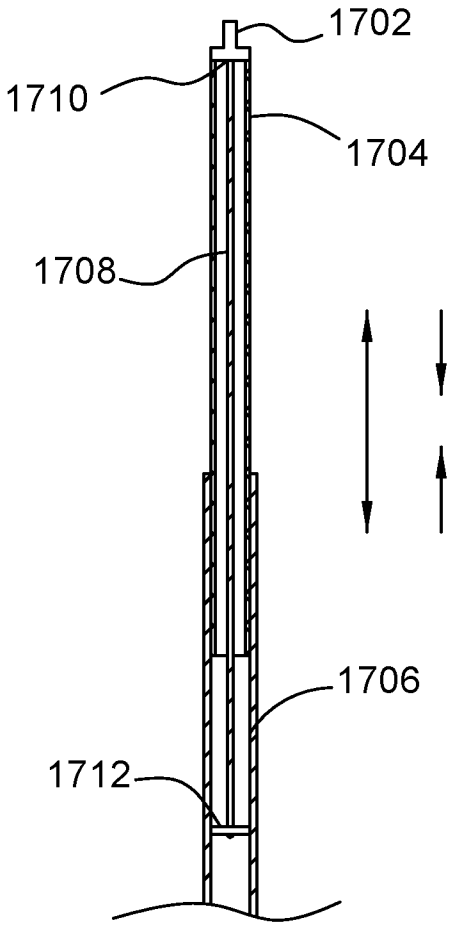
FIG. 17 shows a partial cut-away view of an extension portion for an extendible shoulder hook having a shock absorbing component within the extension, in accordance with some embodiments.

FIG. 17 shows a partial cut-away view of an extension portion for an extendible shoulder hook having a shock absorbing component within the extension, in accordance with some embodiments. A further degree of freedom can be accomplished by not locking the telescoping members at affixed length, and instead, allow some axial movement that tends to return to a given position. A first telescoping member 1704 includes a cap 1702 that can connect, for example, to an upper portion (e.g. 1608, 1610) of an assembly for towing a luggage case. The first telescoping member 1704 slides within a second telescoping member 1706 in a co-axial arrangement. An elastic member 1708 is coupled to the bottom 1710 of the cap 1702 at a first end, and to a fixed point 1712 at a second end in the second telescoping member 1706. The elastic member 1708 can be an elastic cord, a spring, or similar member, and allows the first and second telescoping members 1704, 1706 to move relative to each other on the same axis, but also biases them to a neutral position. In this way if the user lurches or otherwise moves suddenly the elastic member can mitigate the shock to the luggage case by allowing some movement between the first and second telescoping members 1704, 1706.

What is claimed is:

1. A luggage case, comprising:

a case body having a front side, a back side, a top, and a bottom;

at least one pair of wheel components disposed at the bottom of the case body;

a telescoping handle assembly disposed on the back side, comprising:

a telescoping extension disposed in a channel in the back side of the case body, and being telescopically extendible therefrom, the telescoping extension having a distal end;

a horizontal cross member coupled to the distal end of the telescoping extension at a center of the horizontal cross member, the horizontal cross member further having a first end and a second end opposite the first end;

a first shoulder hook coupled to the horizontal cross member at the first end of the horizontal cross member;

a second shoulder hook coupled to the horizontal cross member at the second end of the horizontal cross member;

a swivel at a top of the telescoping extension that allows the horizontal cross member to rotate one hundred eighty degrees relative to an axis of the telescoping extension; and wherein the first shoulder hook and the second shoulder hook each have an arcuate shape.

2. The luggage case of claim 1, wherein the case body includes a first pocket at the top that is configured to receive the first shoulder hook, and a second pocket at the top that is configured to receive the second shoulder hook.

3. The luggage case of claim 1, wherein the luggage case further comprises a first pocket in which to receive the first shoulder hook and a second pocket in which to receive the second shoulder hook.

4. The luggage case of claim 1, wherein the telescoping extension further comprises a pivot point between an upper portion of the telescoping extension and a lower portion of the telescoping extension, wherein the upper portion of the telescoping extension includes the distal end of the telescoping extension.

5. The luggage case of claim 4, further comprising a strap loop disposed on an upper portion of the telescoping extension.

6. The luggage case of claim 5, further comprising a strap that passes through the strap loop and is configured to go around a user's torso.

7. The luggage case of claim 4, further comprising a first pocket at the top of the case body that is configured to receive the first shoulder hook, and a second pocket at the top of the case body that is configured to receive the second shoulder hook.

8. The luggage case of claim 4, further comprising a brace member coupled at a first end to the upper portion of the telescoping extension and at a second end to the lower portion of the telescoping extension, wherein the brace member is configured to fix the upper and lower portions of the telescoping extension at a selected angle relative to each other.

9. A luggage case, comprising:

a case body having a front side, a back side, a top, and a bottom;

at least one pair of wheel components disposed at the bottom of the case body; and a telescoping handle assembly disposed on the back side, and comprising a shoulder hook assembly that collapses into a portion of a wall of the luggage case in a storage position and extends therefrom to any one of different selectable lengths in a towing position, the telescoping handle assembly include a pair of arcuate shoulder hooks that can swivel from the storage position to the towing position;

wherein each of the pair of arcuate shoulder hooks are mounted on an opposing end of a horizontal cross member that is connected at a center of the horizontal cross member to a distal end of a telescoping extension positioned at a center of the back side of the luggage case and are configured to hook over a shoulder of a person to thereby allow the person to tow the luggage case.

10. The luggage case of claim 9, wherein the telescoping extension collapses into a channel formed in a wall of the luggage case at the back side of the luggage case.

11. The luggage case of claim 10, wherein the telescoping extension comprises an upper portion and a lower portion, wherein the upper and lower portions are coupled at a pivot point.

12. The luggage case of claim 11, further comprising a strap loop disposed on an upper portion of the telescoping extension.

13. The luggage case of claim 12, further comprising a strap that passes through the strap loop and is configured to go around a user's torso.

* * * * *